US005116208A

United States Patent [19]

Parme

[11] Patent Number: 5,116,208

[45] Date of Patent: May 26, 1992

[54] SEAL RINGS FOR THE ROLLER ON A ROTARY COMPRESSOR

[75] Inventor: Charles B. Parme, San Diego, Calif.

[73] Assignee: Sundstrand Corporation, Rockford, Ill.

[21] Appl. No.: 570,300

[22] Filed: Aug. 20, 1990

[51] Int. Cl.[5] ..... F04C 18/356; F04C 27/00; F04C 29/02

[52] U.S. Cl. ..... 418/63; 418/94; 418/142

[58] Field of Search ..... 418/63-67, 418/94, 142

[56] References Cited

U.S. PATENT DOCUMENTS

| | | | |
|---|---|---|---|
| 751,872 | 2/1904 | Roach | 418/63 |
| 1,043,697 | 11/1912 | Hayes | 418/63 |
| 1,839,638 | 1/1932 | Beals et al. | 418/144 |
| 2,311,162 | 2/1943 | DuBois | 418/144 |
| 4,293,290 | 10/1981 | Swanson | 418/94 |
| 4,580,957 | 4/1986 | Fickelscher et al. | 418/63 |
| 4,722,676 | 2/1988 | Sugimoto | 418/55.4 |
| 4,824,343 | 4/1989 | Nakamura et al. | 418/55.4 |

FOREIGN PATENT DOCUMENTS

| | | | |
|---|---|---|---|
| 58-107893 | 6/1983 | Japan | 418/142 |
| 61-118586 | 6/1986 | Japan | 418/63 |
| 63-13791 | 1/1987 | Japan | 418/63 |
| 957383 | 5/1964 | United Kingdom | 418/66 |

*Primary Examiner*—John J. Vrablik
*Attorney, Agent, or Firm*—Antonelli, Terry, Stout & Kraus

[57] ABSTRACT

A sliding vane rotary pump which includes a housing having disposed therein a cylinder housing, a roller rotatable mounted in a cylindrical opening of the cylinder housing and bearing plates for closing bottom and top ends of the cylindrical opening. The roller includes a cylindrical tube having an internal space wherein each end of the cylindrical tube is provided with a counterbored surface. A seal ring is disposed within the counterbored surface of each end of the cylindrical tube a width of the seal ring extends over the internal space within the cylindrical tube. The internal space is filled with a pressurized fluid supplied by the compressor. The pressurized fluid in the internal space exerts a biasing force on the seal rings to thereby cause the seal rings to move outwardly from the ends of the roller to form a seal with the bearing plates.

23 Claims, 6 Drawing Sheets

SEAL RINGS FOR THE ROLLER ON A ROTARY COMPRESSOR

TECHNICAL FIELD

The present invention relates to rotary compressors for compressing a fluid. More particularly, the present invention relates to the roller of a sliding vane rotary compressor wherein seal rings are provided in the roller for effectively sealing the ends of the roller to the bearing surfaces.

BACKGROUND ART

Rotary compressors are classified as positive displacement compressors which confine successive volumes of fluid within a closed space in which the pressure of the fluid is increased as the volume of the closed space is decreased.

A specific type of rotary compressor is known in the art as a sliding vane rotary compressor Sliding vane rotary compressors are of two different types. The first type is constructed to include a plurality of sliding vanes within the roller. Between each pair of sliding vanes is defined a closed space which is decreased in volume in order to compress the fluid therein.

Another type of sliding vane rotary compressor provides a single sliding vane which reciprocally engages the surface of the roller. A closed space is defined between the point at which the roller contacts the inside surface of the cylinder and the single sliding vane. Fluid is trapped between the roller and the sliding vane as the roller passes an inlet opening. Further rotation of the roller reduces the volume of the space in which the fluid is trapped. The pressure of the trapped fluid rises until reaching discharge pressure at which time the discharge valve opens and the fluid is expelled from the cylinder.

A typical sliding vane rotary compressor is shown in FIG. 1. The compressor includes a housing 10 having a fluid input 12 and a fluid output 14. A sliding vane 16 is reciprocally mounted within a cylinder housing 18. The cylinder housing 18 includes a cylindrical opening which has disposed therein a shaft 20 and a roller 22. The shaft 20 is hollow. The roller 22 is operably coupled to the shaft 20 though a cam 24. The roller 22 rotates upon the surface of the cam 24. The roller 22 remains in contact with the internal surfaces of the cylindrical opening in the cylinder 18 during its rotation due to its rotation on the surface of the cam 24. The ends of the roller 22 abut against top bearing plate 26 and the bottom bearing plate 28. The top bearing plate 26 closes the top end of the cylindrical opening and the bottom bearing plate 28 closes the bottom end of the cylindrical opening.

As described above, in the sliding vane rotary compressor shown in FIG. 1, fluid is compressed by decreasing the space between the roller 22 and the sliding vane 16 due to the rotation of the roller 22. The compressed fluid is expelled from the cylinder housing 18 into the housing 10. The bottom half 30 of the housing has contained therein oil for lubricating the compressor. Pressurized fluid and oil in the bottom half 30 of the housing 10 flows into a shaft opening 32 of the shaft 20. Due primarily to the rotation of the shaft 20, pressurized fluid and oil flows in an upward direction in the hollow shaft 20 and is output from oil holes 34, 36 and 38 of the shaft 20. Hole 40 in the shaft 20 is a breather hole. Oil flowing from each oil hole lubricates a moving part of the compressor.

Pressurized fluid and oil from oil holes 34, 36 and 38 flow into an internal space 41 within the roller 22. Pressurized fluid and oil eventually flows from the internal space 41 within the roller 22 through an opening in the top bearing plate 26 to lubricate a shaft bearing located in the top bearing plate 26. Pressurized fluid and oil from internal space 41 also flows down through an opening in the bottom bearing plate 28 to lubricate a shaft bearing located in the bottom bearing plate 28. After lubricating the shaft bearings the pressurized fluid and oil separates. The oil returns to the bottom half 30 of the housing 10 and the pressurized fluid travels up to the top half 42 of the compressor and cools the electric motor 43 which rotates the shaft 20.

Pressurized fluid from the top half 42 of the housing 10 is output by the fluid output 14. Being that pressurized fluid flows within the internal space 41 of the roller to the top half 42 of the compressor, a good seal between the ends of the roller 22 and the top and bottom bearing plates 26 and 28 is important. The efficiency of the sliding vane rotary compressor is primarily effected by the seal between the ends of the roller 22 and the top and bottom bearing plates 26 and 28. A good seal between the ends of the roller 22 and the top and bottom bearing plates 26 and 28 prevents the leakage of the pressurized fluid within the internal space 41 to the cylindrical opening in the cylinder housing 18 wherein fluid at a lower pressure is being compressed.

One important requirement with regard to rotary pumps is that the apparatus or method used to form a good seal between the ends of the roller and the bearing plate surfaces must be easily duplicated and lend itself to the interchange of defective parts so that maintenance and repairs can be easily accomplished.

Various methods and apparatus have been proposed for forming a good seal between the ends of the roller and the bearing plates.

For example, it has been proposed that the cylinder housing and the roller be machined to loose tolerances and later custom fitted to each other. This proposed method adds additional steps to the manufacturing and assembly process of a typical sliding vane rotary compressor which are time consuming and costly. Further, this proposed method suffers from the disadvantage of having cylinder housings and rollers which are custom fitted to each other thereby not permitting the interchange of the rollers and cylinder housings during repair and maintenance. Thus, this proposed method although providing a good seal between the ends of the roller and the bearing plates is not the most desirable solution where a large number of compressors are to be produced.

Another proposed method machines the cylinder housings and rollers to exact dimensions thereby improving the interchangeability of the cylinder housings and rollers. However, manufacturing a number of parts to such exact dimensions is extremely difficult, time consuming and costly.

Various other prior art devices have been proposed for forming a good seal between the ends of the roller and the bearing plates.

For example, U.S. Pat. Nos. 4,722,676 and 4,824,343 disclose spiral seals which fit snugly into grooves in the scroll of a scroll-type fluid transferring machine. The spiral shaped seals are designed to have various heights along its length in order to seal the scroll to its bearing surfaces. Such a sealing device does not address the problems associated with a sliding vane rotary compressor. Further, being that the spiral shaped seals are disposed at various heights along its length, uneven wear in the seal results. Still further, the groove formed in the scroll has an inside and outside wall which are necessary to control possible shifting of the spiral shaped seal along its complete length.

U.S. Pat. No. 4,293,290 describes a positive displacement rotary pump having standard "O" ring and rubber seals for engaging the bearing surfaces adjacent each rotor. The seals disclosed by U.S. Pat. No. 4,293,290 suffers from the following disadvantage. Each rotor having an "O" ring or rubber seals thereon must be accurately positioned relative to its bearing surfaces in order that the "O" ring or rubber seals properly engage the bearing surfaces for a good seal.

U.S. Pat. Nos. 1,839,638 and 2,311,162 disclose various apparatus associated with a rotary compressor and a rotary type internal combustion engine. However, neither patent discloses apparatus for effectively sealing a rotor to its bearing surfaces.

DISCLOSURE OF THE INVENTION

The present invention provides sealing apparatus for forming a good seal between the ends of the roller and the bearing plates disposed within a sliding vane rotary compressor. In the present invention seals are disposed within the end of the rollers and are biased in an outward direction by pressurized fluid, which was pressurized by the compressor, to form a good seal with the bearing plates. The biasing of the seals in an outward direction permits the roller to be interchanged with rollers of different compressors in that small variances in the distance between bearing plates of different compressors are compensated for.

By use of the sealing apparatus of the present invention complete interchangeability of the rollers between various sliding vane rotary compressors can be accomplished thereby permitting repairs and maintenance of the sliding vane rotary compressors to be easily performed.

Further, being that it is not necessary to machine the rollers to exact dimensions, the cost of manufacturing the rollers and the associated cylinder housing is not increased thereby.

The present invention is designed to operate in a sliding vane rotary compressor. However, the present invention may be used in any other such device where a good seal between the ends of a device such as a roller and its bearing surfaces is desired.

A sliding vane rotary compressor includes a housing having disposed therein a cylinder housing having a cylindrical opening, an inlet for supplying fluid to the cylindrical opening and an outlet for outputting pressurized fluid from the cylindrical opening. The inlet communicates with a fluid input in the housing. A roller is rotatable mounted in the cylindrical opening of the cylinder housing. A hollow shaft is disposed through an internal space within the roller. The hollow shaft includes a cam which is operably coupled to the roller thereby causing the roller to remain in rolling contact with the inner surface of the cylindrical opening by following the surface of the cam.

A sliding vane is reciprocally mounted in the cylinder housing between the inlet and the outlet in wiping engagement with the roller. A bottom bearing plate is provided for closing a bottom end of the cylindrical opening of the cylinder housing and a top bearing plate is provided for closing a top end of the cylindrical opening of the cylinder housing.

The sliding vane rotary compressor operates by drawing fluid from the inlet into a space formed by the point at which the roller contacts the inner surface of the cylindrical opening and the sliding vane. Rotation of the roller on the cam reduces the volume of the space between the roller and the vane thereby compressing the fluid. The fluid pressure within the space between the roller and the vane increases until the fluid is discharged through the outlet. The outlet of the cylinder housing outputs pressurized fluid to the housing.

The bottom half of the housing contains oil for lubricating moving parts in the compressor. Pressurized fluid and oil flows from the bottom half of the cylinder housing into a shaft opening in the end of the hollow shaft which is positioned in the bottom half of the housing.

Pressurized fluid and oil flowing through the hollow shaft is output through a plurality of oil holes disposed within the shaft. At least one of the oil holes is positioned within the internal space within the roller thus causing pressurized fluid and oil to fill the internal space.

Pressurized fluid and oil from the internal space of the roller flows through openings in the top and bottom bearing plates. The oil from the oil holes lubricates the various rotating parts of the compressor. After lubricating the various rotating parts the pressurized fluid and oil separates. The oil returns to the bottom half of the housing and the pressurized fluid flows to the top half of the housing.

Pressurized fluid flowing to the top half of the housing cools the electric motor which rotates the hollow shaft. The Pressurized fluid is output from the housing through a fluid output disposed at the top of the housing.

The most critical part in the sliding vane rotary compressor of the present invention is the seal between the ends of the roller and the bearing plates. The pressurized fluid within the internal space of the roller must be prevented from leaking into the cylindrical opening of the cylinder housing which contains fluid at a lower pressure that is being compressed.

To prevent leakage of pressurized fluid from the internal space of the roller to the cylindrical opening, the roller of the present invention is constructed using a cylindrical tube wherein each end of the cylindrical tube is provided with a counterbored surface. A single circular seal ring is disposed within each counterbored surface of each end of the cylindrical tube. The width of each seal ring between its inside diameter and its outside diameter may be either greater than the width of the counterbored surface or less than the width of the counterbored surface.

The internal space within the roller is closed by the internal surface of the cylindrical tube, the outside surface of the shaft the bottom surfaces of the seal ring and the bearing plates. The internal space as described above is filled with pressurized fluid compressed by the compressor and oil. The present invention makes use of the pressurized fluid flowing within the internal space of the roller to bias the seals disposed in the ends of the roller in the outward direction thereby causing the seals to abut the bearing plates. The biasing of the seals in the outward direction from the ends of the roller by use of the pressurized fluid causes a good seal to be formed with the bearing plates.

In another embodiment of the present invention, the biasing force exerted on the seal rings by the pressurized fluid is supplemented by resilient devices such as spring washers or the like.

BRIEF DESCRIPTION OF THE DRAWINGS

The features of the present invention which are believed to be novel are set forth with particularity in the appended claims. The invention may be best understood, however, by reference to the following description in conjunction with the accompanying drawings in which:

BEST MODE FOR CARRYING OUT THE INVENTION

Figure 1:
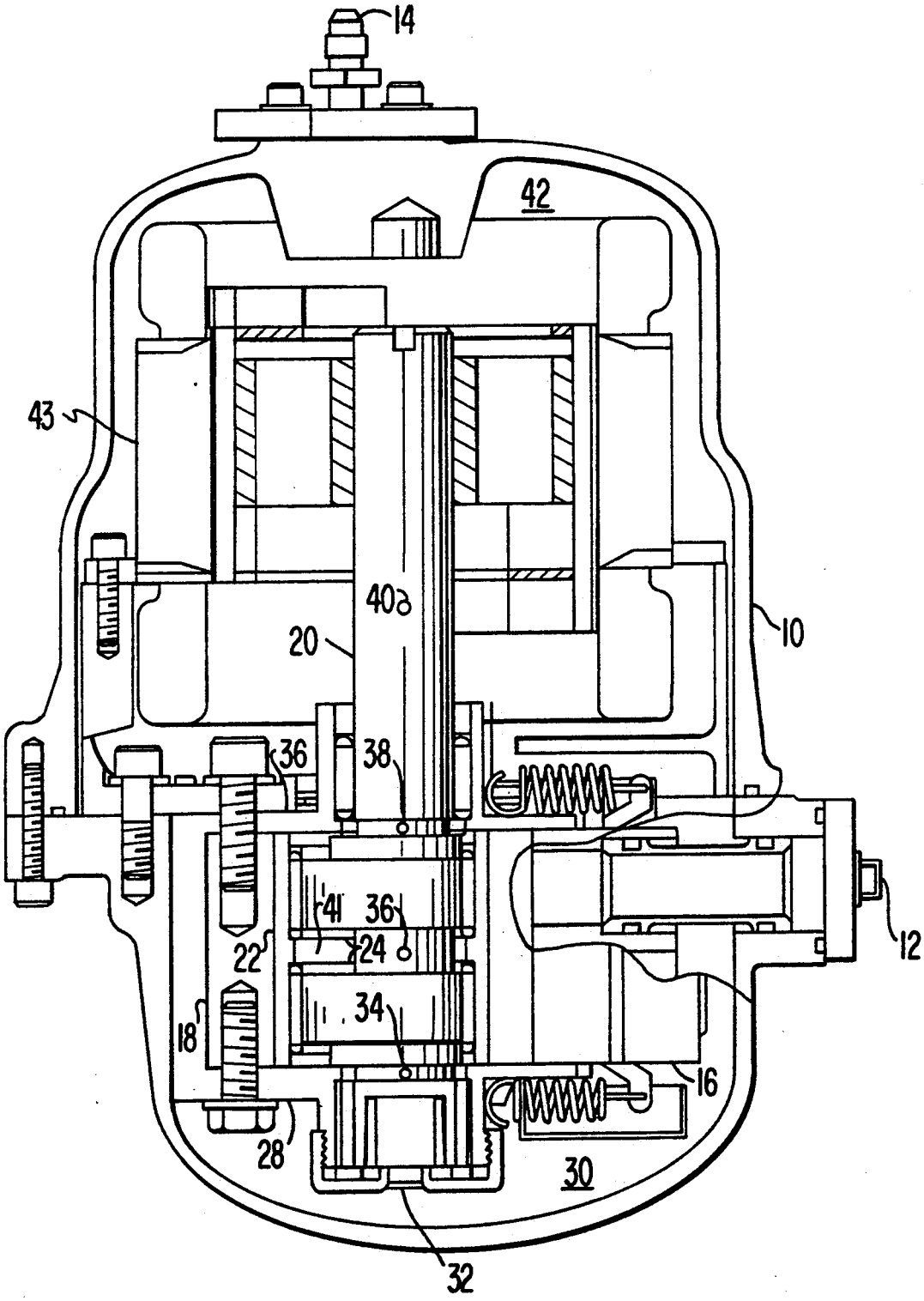
FIG. 1 PRIOR ART
FIG. 1 illustrates a typical sliding vane rotary compressor.

FIG. 1 illustrates a typical sliding vane rotary compressor having a housing 10, a fluid input 12 for inputting fluid and a fluid output 14 for outputting pressurized fluid. The compressor as shown in FIG. 1 includes a single reciprocally mounted sliding vane 16 disposed within a cylinder housing 18. The cylinder housing 18 includes a cylindrical opening, an inlet which communicates with the fluid input 12 and an outlet which outlets pressurized fluid from the cylindrical opening. The cylindrical opening has disposed therein a hollow shaft 20 which is operably coupled to a roller 22 by a cam 24. The roller 22 is caused to rotate on the surface of the cam 24. The cam 24 causes the roller 22 to be in constant rolling contact with the inner surface of the cylindrical opening. The cylindrical opening is closed on the top end by a top bearing plate 26 and is closed on the bottom end by a bottom bearing plate 28.

In the compressor shown in FIG. 1, fluid is drawn into the cylindrical opening through the inlet in the cylinder housing 18 and is compressed by decreasing the space between a point at which the roller 22 contacts the inner surface of the cylindrical opening and the sliding vane 16. Pressurized fluid is outlet from the cylindrical opening through the outlet to the housing 10. The bottom half 30 of the housing contains oil for lubricating moving parts in the compressor.

Pressurized fluid and oil in the bottom half 30 of the compressor flows into a shaft opening 32 in the end of the hollow shaft 20. The pressurized fluid and oil flows from the end of the hollow shaft 20 disposed within the bottom half 30 of the housing toward the other end of the hollow shaft 20 due to rotation of the hollow shaft 20.

The shaft includes a plurality of oil holes 34, 36 and 38. Hole 40 is a breather hole. Oil holes 34, 36 and 38 are disposed within an internal space 41 within the roller 22. The internal space 41 is closed by the surface of the hollow shaft 20, the bearing plates 26 and 28 and the inner surface of the roller 22. Pressurized fluid and oil from oil holes 34, 36 and 38 flow into an internal space 41 within the roller 22. Pressurized fluid and oil eventually flows from the internal space 41 within the roller 22 through an opening in the top bearing plate 26 to lubricate a shaft bearing located in the top bearing plate 26. Pressurized fluid and oil from internal space 41 also flows down through an opening in the bottom bearing plate 28 to lubricate a shaft bearing located in the bottom bearing plate 38. After lubricating the shaft bearings the pressurized fluid and oil separates. The oil returns to the bottom half 30 of the housing 10 and the pressurized fluid travels up to the top half 42 of the compressor and cools the electric motor 43 which rotates the shaft 20. The pressurized fluid in the top half 42 of the housing is output by fluid output 14.

The most critical point which affects the efficiency of the compressor is the seal formed between the ends of the roller 22 and the top and bottom bearing plates 26 and 28. It is very important for the ends of the roller 22 to form good seals with the bearing plates 26, 28 in order to prevent high pressure fluid within the internal space 41 of the roller 22 from leaking into the cylindrical opening of the cylinder housing 18 which contains fluid at a lower pressure being compressed.

Figure 2:
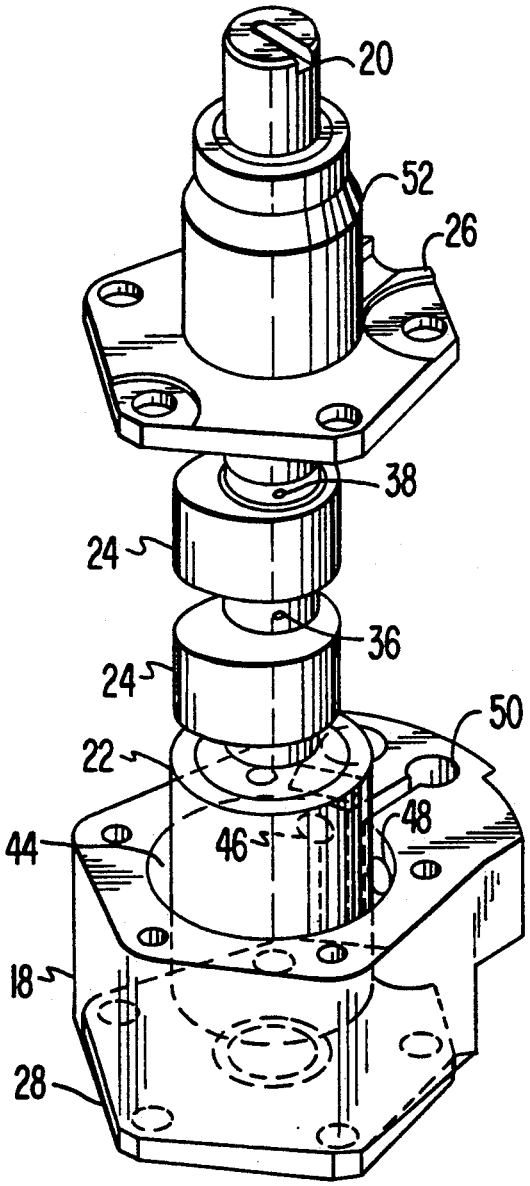
FIG. 2 PRIOR ART
FIG. 2 illustrates a shaft, roller, cylinder housing and bearing plates of a typical sliding vane rotary compressor.

FIG. 2 illustrates the manner in which the hollow shaft 20, the top and bottom bearing plates 26 and 28, respectively, the cylinder housing 18, the cam 24 and the roller 22 are assembled.

The cylinder housing as shown in FIG. 2 includes a cylindrical opening 44, outlet 46 and inlet 48. A slot 50 positioned between inlet 48 and outlet 46 is provided in the cylinder housing 18 for mounting the sliding vane 16 for reciprocal movement As described above, the sliding vane is mounted to be in wiping engagement with the roller 22. The roller 22 is disposed in the cylindrical opening 44 about the hollow shaft 20 to ride the surface of cam 24.

The top bearing plate 26 has integrally formed therewith a tube 52 that houses a shaft bearing and has openings which permits pressurized fluid to flow from the internal space 41 of the roller 22 to the top half 42 of the housing. The bottom bearing plate also contains a shaft bearing.

Figure 3:
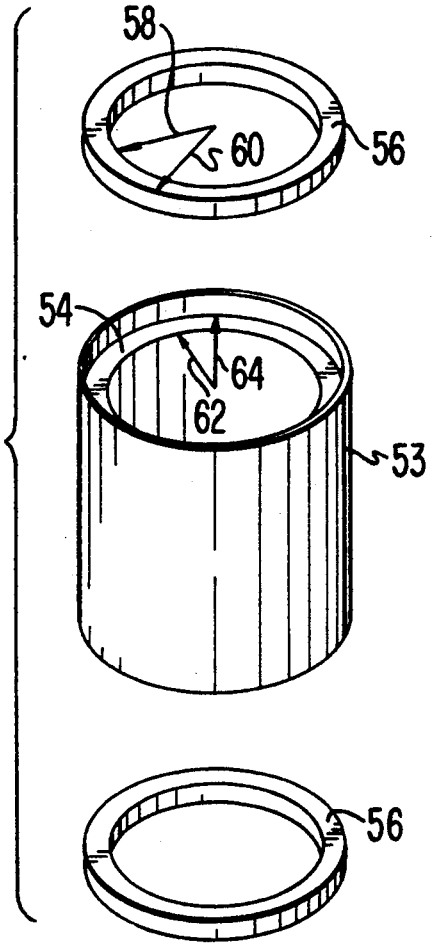
FIGS. 3 and 3*a* illustrate the details of the seals and roller of the present invention.

The present invention provides apparatus for forming a good seal with the top and bottom bearing plates 26 and 28. Particularly, the present invention as shown in FIG. 3 provides that the roller 22 is constructed of a cylindrical tube 53 having a counterbored flat bottom surface 54 at each end thereof perpendicular to the side of the cylindrical tube 53. Circular continuous seal rings 56 are positioned within the ends of the cylindrical tube 53 on the counterbored surfaces 54.

Figure 3A:
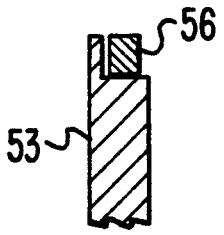

The width of each seal ring 56 between its inner diameter 58 and its outer diameter 60 is shown in FIG. 3 as being greater than the width of the counterbored surface 54 between its inner diameter 62 and its outer diameter 64. However, the width of the seal ring 56 can be smaller than the width of the counterbored surface as shown in FIG. 3*a*.

Figure 4:
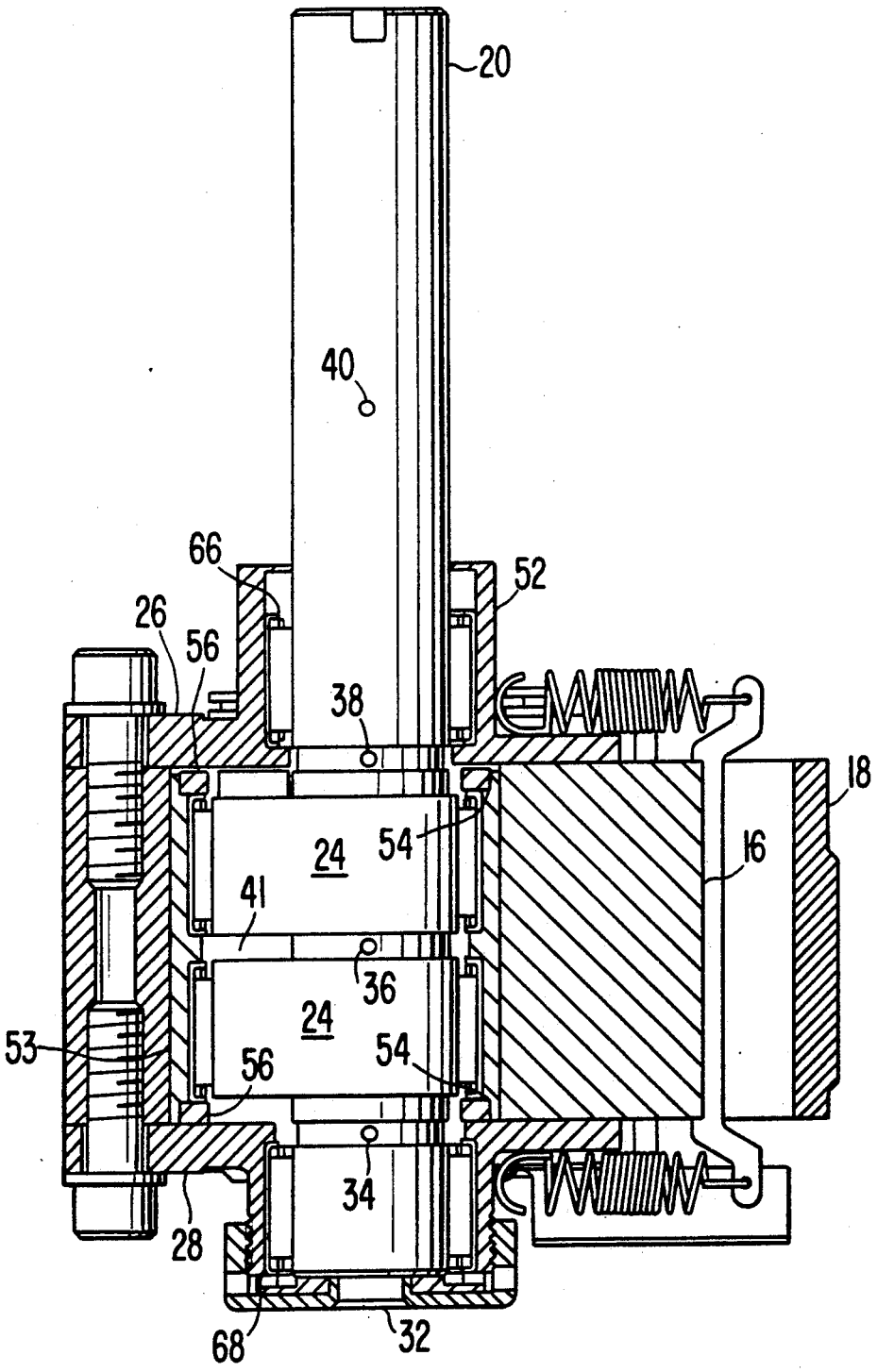
FIG. 4 illustrates an assembly of the shaft, seals, roller, cylinder housing and sliding vane of the present invention shown in FIG. 3.

The apparatus of the present invention is shown in FIG. 4 assembled to the hollow shaft 20, cylinder housing 18, sliding vane 16 and top and bottom bearing plates 26 and 28 respectively. As shown in FIG. 4, the seal rings 56 are positioned upon the counterbored surfaces 54 in the ends of the cylindrical tube 53 of the roller 22. As described above, the roller 22 rides on the surface of the cam 24 and the sliding vane 16 is in wiping engagement with the roller 22. Shaft bearings 66 and 68 are provided in the top and bottom bearing plates 26 and 28 respectively.

The present invention makes use of the pressurized fluid in the internal space 41 of the roller 22 to bias the seals rings 56 in an outward direction from the ends of the roller 22. The pressurized fluid in the internal space 41 of the roller 22 is a mixture of the fluid being compressed and oil. As described above the pressurized fluid and oil is supplied to the internal space 41 by permitting pressurized fluid and oil to flow into the hollow shaft 20 through the shaft opening 32. Thereafter the pressurized fluid and oil is output from the hollow shaft 20 by oil holes 34, 36 and 38 to the internal space 41. The oil flowing from the oil holes 34, 36 and 38 lubricates the moving parts of the compressor, specifically shaft bearings 66 and 68.

Pressurized fluid flowing from oil holes 34, 36 and 38 enters the internal space 41 of the roller 22 and provides the biasing force to the seal rings 56 causing the seal rings to move in an outward direction from the ends of the roller 22 in a direction perpendicular to the flat bottom surface 54 toward a bearing plate. The biasing force causes the seal rings 56 to be in adjacent contact with the top and bottom bearing plates 26 and 28 respectively, thereby forming a good seal between the ends of the roller 22 and the bearing plates 26 and 28.

The seal rings 56, biased by the pressurized fluid within the internal space 41 of the roller 22, forms a good seal with the bearing plates 26 and 28 thereby preventing the leakage of pressurized fluid from the internal space of the roller 22 to the cylindrical opening 44 within the cylinder housing 18.

The roller 22 which is an assembly of the seal rings 56 and the cylindrical tube 53 also permits complete interchangeability of the roller 22 between different compressors being that any variances in distance between the top bearing plate 26 and the bottom bearing plate 28 of different compressors is compensated for by the outward movement of the seal rings 56. Thus the biasing force generated by the pressurized fluid within the internal space 41 of the roller 22 causes the seal rings 56 to extend in the outward direction from the ends of the roller 22 until the seal rings 56 are in adjacent contact with the bearing plates 26 and 28, regardless of the distance between the bearing plates 26 and 28, thereby forming a good seal.

Figure 5:
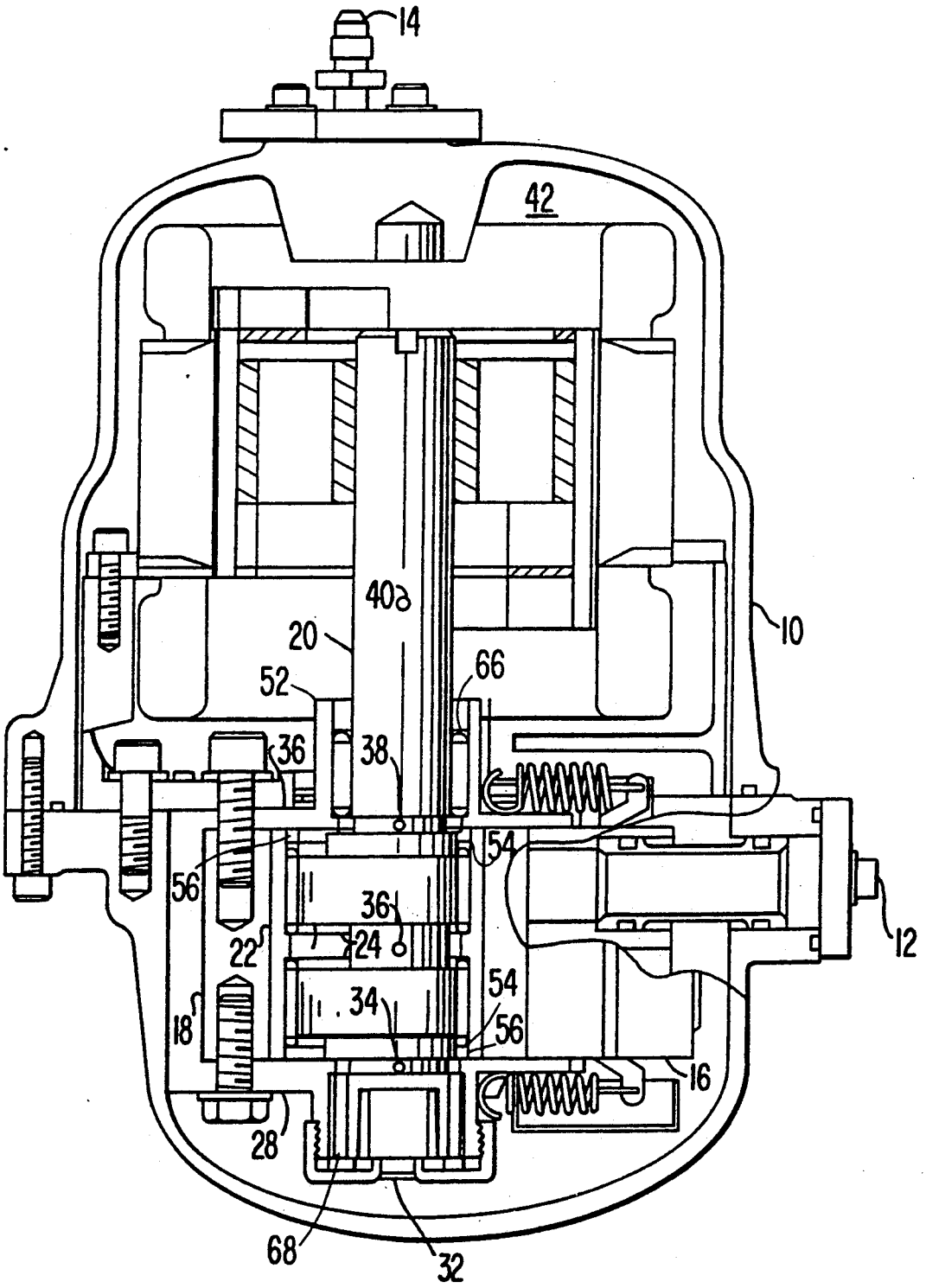
FIG. 5 illustrates a sliding vane rotary compressor which includes the seals and roller of the present invention.

The present invention is shown in FIG. 5 as being assembled within a sliding vane rotary compressor. As can be seen in FIG. 5, the seal rings 56 positioned within the counterbored surfaces 54 in the ends of the roller 22 are biased in an outward direction by pressurized fluid from the oil holes 34, 36 and 38 to be in adjacent contact with the bearing plates 26 and 28, thereby forming a good seal Pressurized fluid and oil from oil holes 34, 36 and 38 flow into an internal space 41 within the roller 22. Pressurized fluid and oil eventually flows from the internal space 41 within the roller 22 through an opening in the top bearing plate 26 to lubricate a shaft bearing located in the top bearing plate 26. Pressurized fluid and oil from internal space 41 also flows down through an opening in the bottom bearing plate 28 to lubricate a shaft bearing located in the bottom bearing plate 28 after lubricating the shaft bearings the pressurized fluid and oil separates. The oil returns to the bottom half 30 of the housing 10 and the pressurized fluid travels up to the top half 42 of the compressor and cools the electric motor 43 which rotates the shaft 20. The pressurized fluid in the top half 42 of the compressor is output by fluid output 14.

Figure 6:
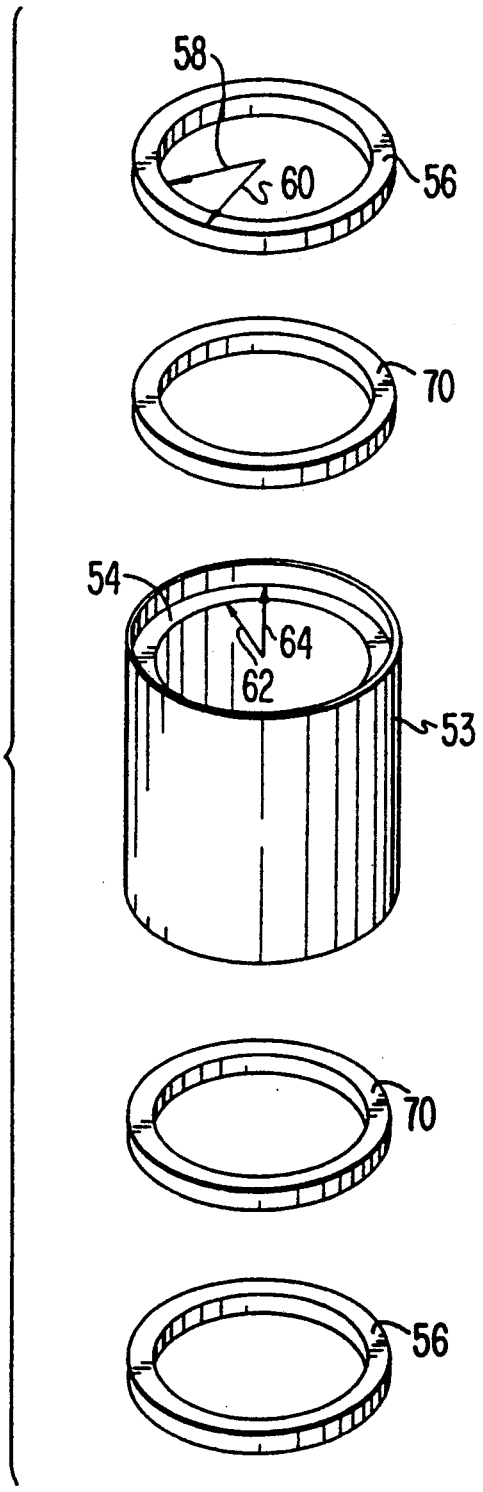
FIG. 6 illustrates another embodiment of the present invention.

Another embodiment of the present invention is shown in FIG. 6 As shown in FIG. 6 a resilient device 70 such as a spring washer is disposed between the seal rings 56 and the counterbored surfaces 54. The biasing force exerted by the pressurized fluid and oil on the seal rings 56 is supplemented by the resilient force generated by the resilient device 70 which may be a spring washer.

While the present invention has been described in terms of its preferred embodiment, it should be understood that numerous modifications may be made thereto without departing from the spirit and scope of the invention as defined in the appended claims For example, the present invention may be used in any application which requires a good seal between the ends of a rotating part and bearing plates. It is intended that all such modifications fall within the scope of the appended claims.

I claim:

1. A sliding vane rotary compressor including a cylinder housing having a cylinder opening, an inlet for supplying a fluid to be compressed to said cylindrical opening and an outlet for outputting pressurized fluid from said cylindrical opening, a roller rotatably mounted in said cylindrical opening, a shaft having a cam which is operably coupled to said roller causing said roller to follow the surface of said cam, a sliding vane reciprocally mounted in said cylinder housing between said inlet and said outlet in wiping engagement with said roller, a bottom bearing plate for closing a bottom end of said cylindrical opening and a top bearing plate for closing a top end of said cylindrical opening, said roller comprising:

a cylindrical tube having an internal space, wherein each end of said cylindrical tube is provided with a counterbored surface, said counterbored surface having a flat bottom surface perpendicular to the side of said cylindrical tube; and a continuous seal ring disposed within said counterbored surface of each end of said cylindrical tube such that said continuous seal ring rests on said flat bottom surface of said counterbored surface;

said internal space being filled with a pressurized fluid which generates a force biasing each continuous seal ring in a direction perpendicular to said flat bottom surface toward a bearing plate, thereby forming a seal with said bearing plate.

2. A sliding vane rotary compressor according to claim 1, wherein said pressurized fluid in said internal space is supplied by said compressor.

3. A sliding vane rotary compressor according to claim 2, wherein said shaft is hollow and includes a plurality of oil holes.

4. A sliding vane rotary compressor according to claim 3, wherein oil is supplied to moving parts of said compressor through said hollow shaft and said oil holes.

5. A sliding vane rotary compressor according to claim 4, wherein fluid compressed by said compressor is supplied to said internal space by said hollow shaft and said oil holes.

6. A sliding vane rotary compressor including a cylinder housing having a cylindrical opening, an inlet for supplying a fluid to be compressed to said cylindrical opening and an outlet for outputting pressurized fluid from said cylindrical opening, a roller rotatably mounted in said cylindrical opening, a shaft having a cam which is operably coupled to said roller causing said roller to remain in rolling contact with the inner surface of said cylindrical opening, a sliding vane reciprocally mounted in said cylindrical housing between said inlet and said outlet in wiping engagement with said roller, a bottom bearing plate for closing a bottom end of said cylindrical opening and top bearing plate for closing a top end of said cylindrical opening, said roller comprising:

a cylindrical tube having an internal space, wherein each end of said cylindrical tube is provided with a counterbored surface, said counterbored surface having a flat bottom surface perpendicular to the side of said cylindrical tube;

resilient means which rests on said flat bottom surface within said counterbored surface of each end of said cylindrical tube; and a continuous seal ring disposed within said counterbored surface of each end of said cylindrical tube on said resilient means;

said internal space being filled with a pressurized fluid which generates a force biasing each continuous seal ring in a direction perpendicular to said flat bottom surface toward a bearing plate, thereby forming a seal with said bearing plate; and said resilient means providing a resilient force supplementing said biasing force.

7. A sliding vane rotary compressor according to claim 6, wherein pressurized fluid in said internal space is supplied by said compressor.

8. A sliding vane rotary compressor according to claim 7, wherein said shaft is hollow and includes a plurality of oil holes.

9. A sliding vane rotary compressor according to claim 8, wherein oil is supplied to moving parts of said compressor through said hollow shaft and said oil holes.

10. A sliding vane rotary compressor according to claim 9, wherein fluid compressed by said compressor is supplied to said internal space through said hollow shaft and said oil holes.

11. A sliding vane rotary compressor according to claim 6, wherein said resilient means is a spring washer.

12. A sliding vane rotary compressor according to claim 1, wherein said width of each of said seal rings is greater than a width of a corresponding flat bottom surface.

13. A sliding vane rotary compressor according to claim 6, wherein said width of each of said seal rings is greater than a width of a corresponding flat bottom surface.

14. A sliding vane rotary compressor according to claim 1, wherein said width of each of said seal rings is less than a width of a corresponding flat bottom surface.

15. A sliding vane rotary compressor according to claim 6, wherein said width of each said seal rings is less than a width of a corresponding flat bottom surface.

16. A roller for use in a sliding vane rotary compressor comprising:

a cylindrical tube having an internal space, wherein each end of said cylindrical tube is provided with a counterbored surface, said counterbored surface having a flat bottom surface perpendicular to the side of said cylindrical tube; and a continuous seal ring disposed within said counterbored surface of each end of said cylindrical tube such that said continuous seal ring rests on said flat bottom surface of said counterbored surface;

said internal space being filled with a pressurized fluid which generates a force biasing each continuous seal ring in a direction perpendicular to a corresponding flat bottom surface outward from an end of said cylindrical tube, thereby forming a seal with bearing plates of said compressor.

17. A roller for use in a sliding vane rotary compressor comprising:

a cylindrical tube having an internal space, wherein each end of said cylindrical tube is provided with a counterbored surface, said counterbored surface having a flat bottom surface perpendicular to the side of said roller;

resilient means which rest on said flat bottom surface within said counterbored surface of each end of said cylindrical tube; and a continuous seal ring disposed within said counterbored surface of each end of said cylindrical tube on said resilient means;

said internal space being filled with a pressurized fluid which generates a force biasing each continuous seal ring in a direction perpendicular to a corresponding flat bottom surface outward from an end of said cylindrical tube, thereby forming a seal with bearing plates of said compressor.

18. A roller according to claim 16, wherein said pressurized fluid in said internal space is supplied by said compressor.

19. A roller according to claim 16, wherein said width of each of said continuous seal rings is greater than a width of a corresponding flat bottom surface.

20. A roller according to claim 17, wherein pressurized in said internal space is supplied by said compressor.

21. A roller according to claim 17, wherein said width of each of said seal rings is greater than a width of said counterbored surface.

22. A roller according to claim 16, wherein said width of each of said continuous seal rings is less than a width of a corresponding flat bottom surface.

23. A roller according to claim 17, wherein said width of each of said continuous seal rings is less than a width of a corresponding flat bottom surface.

* * * * *